United States Patent [19]

Travis

[11] Patent Number: 4,838,817

[45] Date of Patent: Jun. 13, 1989

[54] TROLLING MOTOR HAVING PIVOTAL FOOT ELEMENT

[76] Inventor: Steed Travis, Rte. 6, Box 73D, Maryville, Tenn. 37801

[21] Appl. No.: 190,702

[22] Filed: May 5, 1988

[51] Int. Cl.[4] ..... B63H 5/12

[52] U.S. Cl. ..... 440/6; 440/53; 440/71

[58] Field of Search ..... 440/6, 7, 65, 71, 64, 440/53, 56; 16/292, 297

[56] References Cited

U.S. PATENT DOCUMENTS

| | | | |
|---|---|---|---|
| Re. 30,567 | 4/1981 | Meredith et al. | 248/642 |
| 1,460,570 | 7/1923 | Buehener . | |
| 3,096,058 | 7/1963 | Torre | 248/4 |
| 3,220,675 | 11/1965 | Cooper | 248/4 |
| 3,274,849 | 9/1966 | Hanson | 74/480 |
| 3,424,412 | 1/1969 | Gayle | 248/4 |
| 3,698,672 | 10/1972 | Gilbert | 248/4 |
| 4,224,893 | 9/1980 | Vollmar | 440/6 X |
| 4,548,586 | 10/1985 | Phillips, Jr. | 440/6 |

FOREIGN PATENT DOCUMENTS

| | | | |
|---|---|---|---|
| 660507 | 2/1964 | Italy | 440/65 |

*Primary Examiner*—Sherman D. Basinger

*Attorney, Agent, or Firm*—Luedeka, Hodges & Neely

[57] ABSTRACT

A trolling motor for a boat including collar sections mounting the motor to the boat, a shaft leading from the mounting collar sections to the foot, a foot adapted to be disposed beneath the surface of a body of water, such shaft being hinged along its length such that the foot may swing from its position for propelling the boat toward a horizontal position substantially out of the water when the boat is powered other than by the trolling motor. The foot includes an alignment skeg and deflection shield mounted on the nose of the foot and adapted to urge the foot toward a horizontal position when the boat is moving forwardly under power other than the trolling motor.

2 Claims, 5 Drawing Sheets

TROLLING MOTOR HAVING PIVOTAL FOOT ELEMENT

FIELD OF THE INVENTION

This invention relates to trolling motors for boats, particularly fishing boats.

BACKGROUND OF THE INVENTION

Trolling motors normally are utilized as supplementary power devices for fishing boats and the like. They are of low power and are adapted to move the boat quietly, but slowly, between fishing locations. These motors customarily are mounted on either the bow or transom of a boat with the foot of the motor disposed beneath the surface of the water when the trolling motor is in use. When it is desired to move a considerable distance between fishing locations, for example, it is customary to raise the trolling motor out of the water by either tilting the entire motor at its mounting location so that the foot is out of the water or by loosening certain mounting elements so that the motor can be raised vertically out of the water. It is important that the trolling motor foot be out of the water when moving forwardly when the boat is under power as by the prime outboard motor of the boat, so that the foot is not subjected to possible damage due to striking underwater objects or the like. Further, the maneuverability of a fishing boat by the prime motor is impaired when the foot of the trolling motor is disposed beneath the water. In the instance of present day high powered outboard motors, the strain on the mounting of a trolling motor when the boat is underway at high speeds using the prime motor can destroy the mount and/or that portion of the boat on which the trolling motor is mounted.

As noted, it is known in the prior art to tilt the entire motor out of the water or to loosen mounting elements to raise the trolling motor vertically, either action intended to move the foot of the trolling motor out of the water. Either of these activities requires that the operator of the boat take positive action. Such action is time consuming and may not be remembered so that damage to the trolling motor occurs inadvertently.

Accordingly, it is an object of the present invention to provide a trolling motor in which the foot element may be moved substantially out of the water without altering the mounting position of the trolling motor and without the attention of the boat operator.

It is another object of the present invention to provide a trolling motor which automatically raises the foot portion of the trolling motor from beneath the surface of the water when the boat is powered forwardly by the prime motor of the boat.

SUMMARY OF THE INVENTION

In accordance with the present invention, there is provided a trolling motor which includes a vertical shaft extending from a mounting to the transom, or the appropriate location, of the boat downwardly to position the foot of the trolling motor beneath the surface of the water in which the boat is located. At a location along the length of the vertical shaft intermediate of the mounting and foot, there is provided a blind hinge which permits the lowermost portion of the shaft and the foot to pivot between vertical and substantially horizontal positions. The orientation of the blind hinge is such that when the foot is in its lowered position, and under power, the shaft is rigid and transmits power from the foot to the boat to move the boat through the water. The foot is provided with an alignment skeg for rotating the foot into alignment with the forward direction of the boat when the boat is moving forwardly under power other than the trolling motor. A deflection shield is mounted on the nose of the foot in position to deflect the foot toward a horizontal position when the boat is moving forwardly, such deflection shield acting in the nature of a sled towed behind the boat when the boat is moving forwardly, to urge the foot toward a horizontal position and out of the water. When the prime motor of the boat is stopped, the effect of the deflection shield is negligible and the foot returns by gravity to its vertical position for powering the boat forwardly. Because the hinge means employed in the present invention provides only for pivotal movement in a single plane, and through an angle of approximately 45 degrees within such plane, the foot portion when in its vertical alignment position, is able to propel the boat regardless of the rotational position of the shaft of the motor.

DETAILED DESCRIPTION OF THE INVENTION

Figure 1:
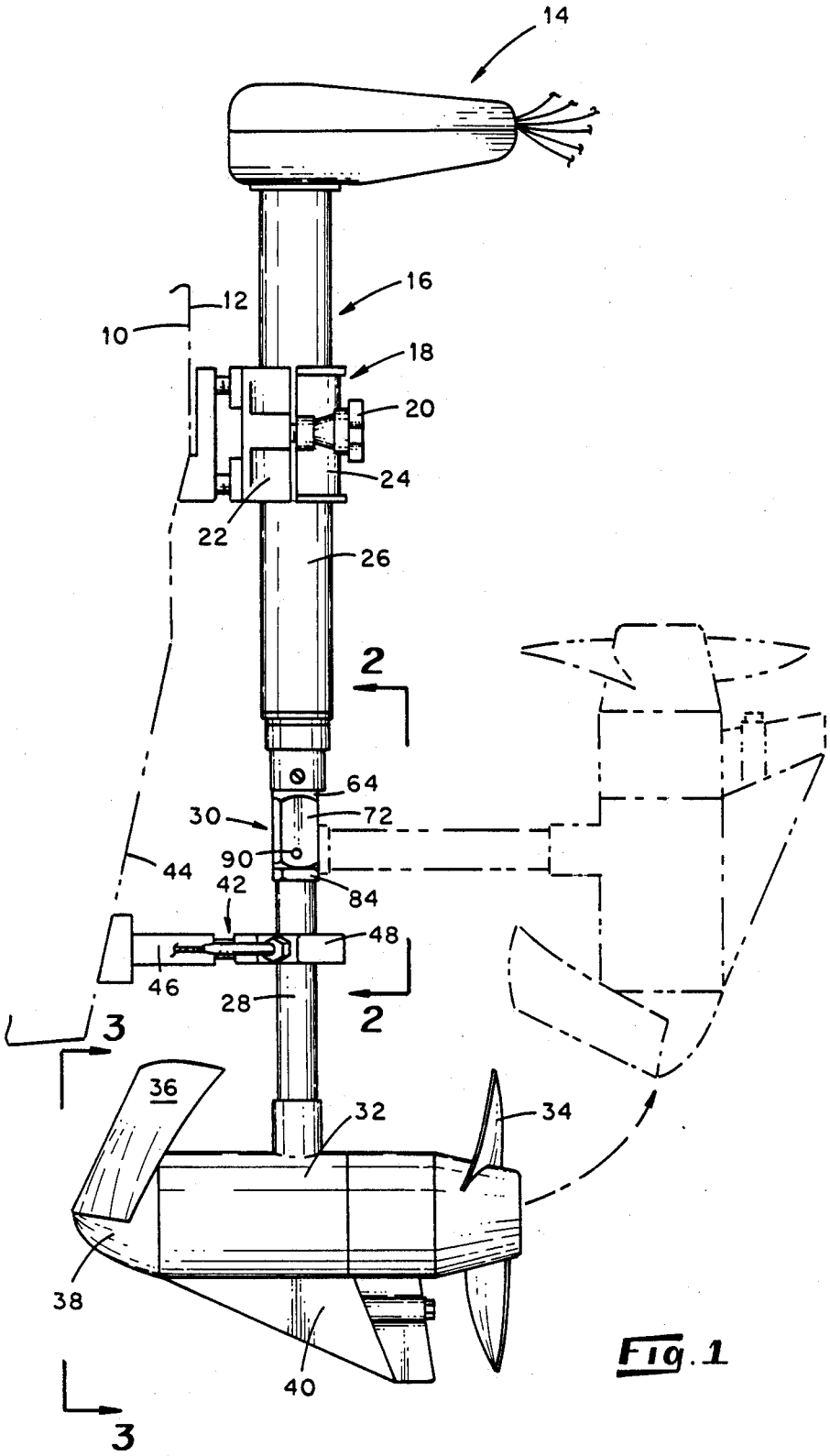
FIG. 1 is a representation of a trolling motor in accordance with the present invention as mounted on the transom of a boat and depicting the pivotal movement of the foot portion of the motor in phantom.

With reference to FIG. 1, there is depicted fragmentarily a boat 10 including a transom 12 to which there is mounted a trolling motor indicated generally at 14. The motor 14 includes a first shaft section 16 which is received in a mounting means 18 that is secured to the transom 12 of the boat. In the present invention, any suitable mounting means may be employed for securing the trolling motor to the boat. It is not necessary that the boat be mounted to the transom, but rather it may be mounted at other positions on the boat, any of which may be suitable to provide for disposing the motor beneath the surface of the water in position to propel the boat. The depicted mounting means includes a first collar section 22 and a second collar section 24 that are held together as by a mounting knob 20 to frictionally engage the circumference of the shaft 16. This mounting means, as well as other mounting means well known in the art, provide for vertical positioning of the shaft 16 relative to the mounting means 18.

In accordance with the present invention, the shaft 16 is divided into an upper first section 26 and a lower second section 28. These two sections are connected as by a blind hinge indicated generally at 30 at a location intermediate of the mounting means and a foot 32. The lowermost end of the second shaft section 28 serves to mount the foot 32 which has a propeller 34 mounted on its trailing end and a deflection shield 36 mounted on its nose portion 38. An alignment skeq 40 is provided on the lowermost surface of the foot 32 in position to assure orientation of the foot 32 with the forward direction of movement of the boat when the boat is powered by a prime motor (not shown) such as the well known outboard motor employed on fishing boats.

Figure 2:
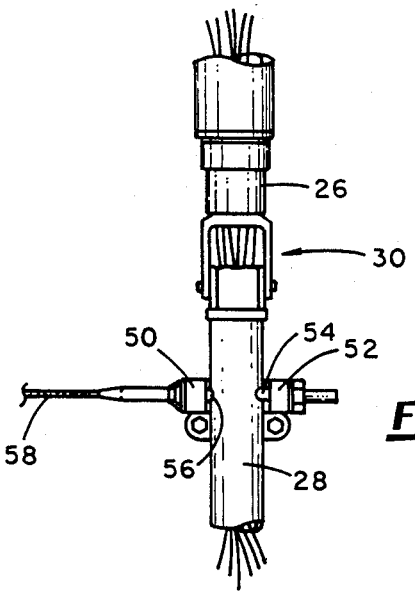
FIG. 2 is a fragmentary view of a portion of the shaft of the motor of FIG. 1 as taken along lines 2—2 of FIG. 1.

Optionally, there is provided a locking mechanism 42 mounted to the lowermost portion 44 of the boat transom 12 and extending therefrom in position to receive the lower shaft section 28 in engagement therewith. The depicted locking mechanism 42 includes a base 46 which is secured directly to the boat and a yoke 48 mounted to the outboard end of the base 46. As best seen in FIG. 2, the yoke 48 includes first and second legs 50 and 52 which partially encircle the shaft section 28. Within the outboard end of the leg 52 there is provided a spring loaded detent 54 which is urged toward the shaft 28. In the leg 50 there is provided a further detent 56 which is also spring biased toward the shaft 56. The detent 56 is further connected as by a cable 58 to a control knob (not shown) within the boat in position such that the operator can exert a pull upon the cable 58 to release the detent 56 and thereby permit the free pivotal movement of the second shaft section 28 out of its location between the legs 50 and 52 of the yoke 48. In accordance with the present invention, the yoke 48 with its spring biased detents provides for selective restraint against pivotal movement of the shaft section 28 away from a vertical alignment between the lower shaft section 28 and the upper shaft section 26. Because of the spring biased nature of the detents 54 and 56, should the foot 32 of the motor strike an underwater object, the force exerted against the shaft 28 will be sufficient to overcome the spring bias of the detents and permit the lower shaft section 28 to pivot the foot upwardly in response to the force against the foot. However, the spring bias is chosen to be of a magnitude such that under normal operation of the trolling motor, the shaft section 28 will not pivot out of the yoke 48 unless the operator purposely releases the spring tension on the detent 56 by exerting a pull on the cable 58.

Figure 4:
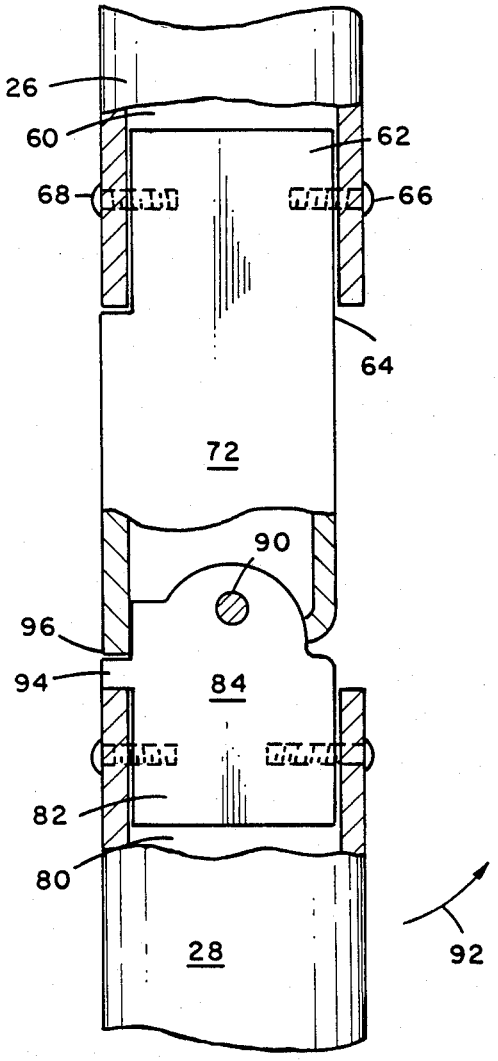
FIG. 4 is a side view of one embodiment of a blind hinge , partly cut away, for providing pivotal movement of the foot of the motor depicted in FIG. 1.
Figure 5:
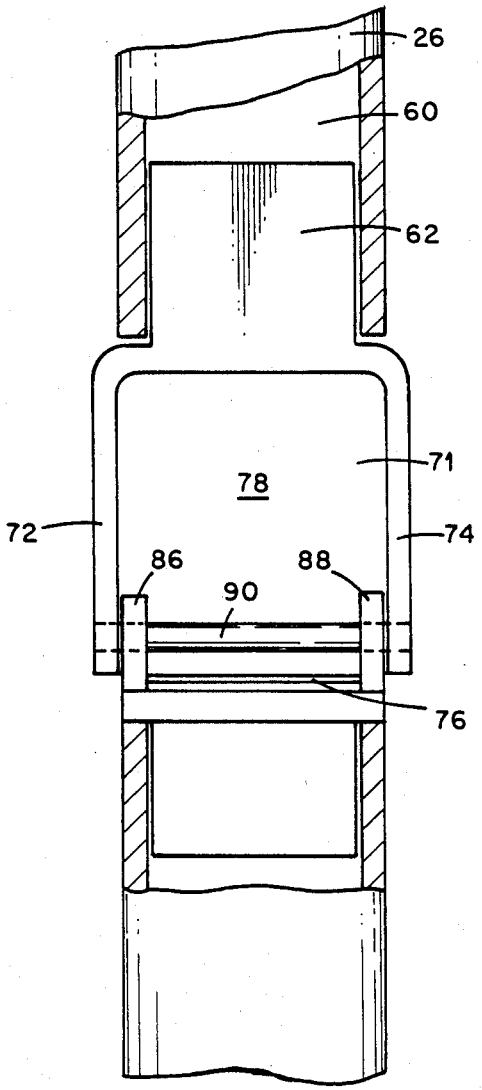
FIG. 5 is a rear view of the hinge of FIG. 4.

With specific reference to FIGS. 4 and 5, there is depicted one embodiment of a blind hinge for providing the desired pivotal movement of the foot 32 with respect to the upper shaft section 26. As depicted, the upper shaft section 26 includes an open end 60 within which there is received a reduced diameter end 62 of a plug 64. The plug 64 is held within the end 60 as by means of screws 66 and 68. The lowermost end 70 of the plug 64 defines a rigid receptacle 71 including sidewalls 72 and 74 and an open end 76. Further, the receptacle includes an open side 78. As further seen in FIGS. 4 and 5, the lower shaft section 28 includes an open end 80 within which there is received one end 82 of a plug 84. This plug projects from the end of the shaft 28 in the form of two wings 86 and 88 that are disposed within the receptacle 71 between the sidewalls 72 and 74 thereof. Pin means 90 extends between the side members 72 and 74 of the receptacle 71 and through the wings 86 and 88 of the plug 84 to pivotally mount the lower shaft section 28 with respect to the upper shaft section 26. As depicted in FIGS. 4 and 5, the wings 86 and 88 are of generally hemispherical geometry and each includes a rear flat surface portion (only surface 87 is visible in the FIGURES) such that the lower shaft section 28 may pivot in the direction of the arrow 92 shown in FIG. 4 about the pivotal axis of the pin 90. When the shaft 92 is thus pivoted, the shaft section 28, through its plug extension 84, enters the open side 78 of the receptacle 71. Pivotal movement of the shaft 28 is provided through an angle of at least about 45 degrees, and preferably through an angle of about 120 degrees from its position of vertical alignment with the shaft section 26, such pivotal movement being limited to a plane that is normal to the pivotal axis of the pin 90 and in the direction indicated by the arrow 92.

As shown in FIG. 4, the plug 84 includes a stop 94 in position to engage the lower edge 96 of the receptacle 71 when the shaft section 28 has pivoted in the reverse direction of the arrow 92 and into vertical axial alignment with the shaft section 26. Simultaneously, the flat surface portions of the wings 86 and 88 come to bear against the inner surface of the receptacle 71 to provide additional resistance to pivotal movement of the shaft section 28 past vertical axial alignment with the shaft section 26. This pivotal movement of the shaft 28, hence the foot 32, is further depicted in FIG. 1 where it will be recognized that when the foot 32 is pivoted to its lowermost position and the propeller 34 is powered, a forward thrust is exerted through the shaft 28, through the blind hinge 30 and the upper shaft 26 to the boat 10 to move the boat forwardly through the water. As is desired with trolling motors, the shaft 16 is rotatable about its longitudinal axis to change the direction of forward thrust by the propeller 34. Due to the nature of the limited pivotal movement provided by the blind hinge 30, such rotation of the trolling motor to change direction of the thrust of the motor to the boat is fully provided for without the foot pivoting upwardly out of its position for propelling the boat. A full 360 degree rotation of the trolling motor may be accomplished if desired.

Figure 3:
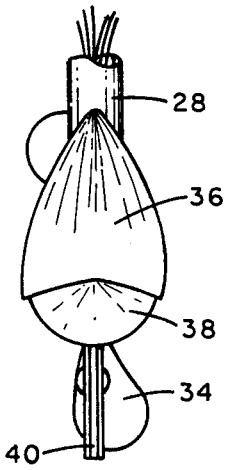
FIG. 3 is a fragmentary view taken along the line 3—3 of FIG. 1 and depicting the deflection shield on the foot of the trolling motor.

As shown in FIGS. 1 and 3, the nose 38 of the foot 32 is provided with a deflection shield 36. This deflection shield is preferably mounted to the nose 38 and extends upwardly and rearwardly over the upper portion of the foot 32 to act as a drag against water movement therepast when the boat is moving forwardly through the water. This deflection shield is preferably of a geometry that provides relatively little resistance to movement of the boat through the water when the trolling motor is in use, but which provides significant resistance to water movement therepast when the boat is under power from the prime motor. When the prime motor is activated and the boat is moved forwardly through the water at a relatively high rate of speed, the deflection shield 36 enhances the normal drag of the foot 32 to cause the foot 32 to pivot from its vertical position as seen in FIG. 1 toward a horizontal position, depicted in phantom in FIG. 1, which is substantially parallel to the surface of the body of water through which the boat is traveling. As best seen in FIG. 1, as the foot 32 pivots toward its horizontal position, a maximum area of the deflection shield is presented to the water through which the boat is traveling to act in the nature of a sled which urges the foot 32 out of the water. It has been found that this shield essentially slides along the surface of the water behind the boat when the boat is powered by the prime motor to ensure that the foot is substantially out of the water at such times. Further, the shield acts as a protection against the foot 32 striking underwater or floating objects while the boat is being propelled by the prime motor.

To ensure that the shield 36 is in position to present itself as a resistance to the movement of water therepast, the foot 32 is provided with a skeg 40 which functions to align the foot 32 toward a rotational position in which the deflection shield faces forwardly of the direction of movement of the boat through the water when the boat is powered by the prime motor.

When the prime motor has been deactivated, the foot 32 pivots downwardly by gravity to a position where the stop 94 engages the lower edge 96 of the receptacle 71 and thereby position the foot for operation of the propeller 34 to propel the boat through the water. Further, in similar manner, when the boat is being powered by the trolling motor and the foot contacts aquatic plants such as lilies, weeds, etc., the present invention permits the foot to pivot up and ride over the plants and then return by gravity and/or the thrust of the propeller 34 to its proper position for powering the boat. This feature is enhanced by the presence of the skeg and shield on the foot.

Whereas specific embodiments have been depicted and described, it is understood that various modifications of the invention will be recognized by those skilled in the art and are intended to be encompassed within the scope of the invention which is limited only as set forth in the claims appended hereto.

What is claimed:

1. In a trolling motor for a boat including means mounting the trolling motor to the boat, a foot adapted to be disposed underneath the surface of a body of water, propeller means associated with said foot for propelling the boat through the body of water, said foot including a nose portion and a trailing portion serving to mount the propeller means, and shaft means connecting said foot to said mounting means, the improvement comprising blind hinge means interposed along the length of said shaft and dividing said shaft into first and second sections, said first section extending between said hinge means and said means mounting said motor to said boat, and said second section extending between said hinge means and said foot, and including means defining a water deflection shield disposed on said nose portion of said foot in position to exert a drag against forward movement of said foot through said body of water wherein said shield extends from a leading edge of said nose portion upwardly and rearwardly of said nose portion such that when said second shaft section is disposed substantially horizontally, a maximum area of said shield is exposed to the flow of water therepast thereby tending to urge said second shaft section toward such horizontal position.

2. In a trolling motor for a boat including means mounting the trolling motor to the boat, a foot adapted to be disposed underneath the surface of a body of water, propeller means associated with said foot for propelling the boat through the body of water, said foot including a nose portion and a trailing portion serving to mount the propeller means, sand shaft means connecting said foot to said mounting means, the improvement comprising blind hinge means interposed along the length of said shaft and dividing said shaft into first second sections, said first section extending between said hinge means and said means mounting said motor to said boat, and said second section extending between said hinge means and said foot wherein said blind hinge means comprises a first plug adapted to be received within on open end of said first shaft section and depend therefrom to define a rigid receptacle having opposed side members, at least one open side, and an open lowermost end, and a second plug adapted to be received within one open end of said second shaft section and extend therefrom to be received in said open lowermost end of said receptacle, pin means pivotally connecting said first and second plugs to one another at a location with said receptacle and between said opposed side members whereby said second shaft section is free to pivot only within a plane that is normal to the pivotal axis of said pin means and in a direction that causes said second shaft section to move within said open side of said receptacle, said second plug including stop means defined thereon in position to engage said receptacle to limit pivotal movement of said second shaft section beyond axial alignment with said first shaft section when said second shaft section is pivoted downwardly about the pivot axis of said pin means.

* * * * *